US005694804A

United States Patent [19]

Grabbe

[11] Patent Number: 5,694,804

[45] Date of Patent: Dec. 9, 1997

[54] STAMPING AND FORMING MACHINE HAVING HIGH SPEED TOGGLE ACTUATED RAM

[75] Inventor: Dimitry G. Grabbe, Middletown, Pa.

[73] Assignee: The Whitaker Corporation, Wilmington, Del.

[21] Appl. No.: 417,286

[22] Filed: Apr. 3, 1995

[51] Int. Cl.[6] ..... B21J 9/18

[52] U.S. Cl. ..... 72/451; 72/452.5; 100/282

[58] Field of Search ..... 72/450, 451, 452.5; 100/282

[56] References Cited

U.S. PATENT DOCUMENTS

| | | | |
|---|---|---|---|
| 2,251,135 | 7/1941 | Iknayan et al. | 164/22 |
| 2,280,587 | 4/1942 | Klocke | 72/451 |
| 3,661,008 | 5/1972 | Richardson | 72/451 |
| 4,434,646 | 3/1984 | Maeda et al. | 72/451 |

FOREIGN PATENT DOCUMENTS

| | | | |
|---|---|---|---|
| 0 162 290 | 11/1985 | European Pat. Off. | B26F 1/38 |
| 60 118 335 | 6/1985 | Japan . | |

OTHER PUBLICATIONS

Patent Abstracts of Japan: vol. 009, No. 275 (M-426), 2 Nov. 1985 & JP,A,60 118335 (Matsushita Denko KK), 25 Jun. 1985.

*Primary Examiner*—David Jones

[57] ABSTRACT

A stamping and forming machine (10) is provided for performing stamping and forming operations on strip material (274). The machine includes a ram (26) that reciprocates toward and away from a base plate (14). The ram carries tooling (362) that engages mating tooling (364) on the base plate for performing the stamping and forming operations. A toggle mechanism (222, 224, 226, 232, 238) is coupled to the ram (26) and the drive shaft (40) by means of a connecting rod (70) that moves the toggle over center (250) and then back again every revolution of the drive shaft. This provides two ram strokes of different lengths for each revolution of the drive shaft (40).

36 Claims, 12 Drawing Sheets

STAMPING AND FORMING MACHINE HAVING HIGH SPEED TOGGLE ACTUATED RAM

The present invention is related to machines that perform stamping and forming operations on strip material, and more particularly to such machines having relatively high speed reciprocating rams.

BACKGROUND OF THE INVENTION

Stamping and forming machines utilize profiling die stations to cut openings in sheet material, the workpiece, in the manufacture of various products. Typically, these dies consist of a punch and mating die which are arranged to engage the workpiece to cut the opening and then to disengage so that the workpiece can be advanced to the next station for additional operations. As the punch approaches the die it engages the surface of the workpiece, pushing it against the die opening and forcing a slug of the material through the opening and into an area where the scrap slugs are collected and removed from the tooling. Occasionally, one of these scrap slugs sticks to the end of the punch, after blanking, and is pulled into the opening that was just formed in the workpiece where it may lodge. This is known as "slug pulling" or "slug back out" in the industry. This slug then may extend partially beyond the edge of the freshly cut opening in the workpiece and cause a misfeed or other damage to the workpiece. This can cause serious damage to the tooling or the machine. In any case, this results in a damaged product that must be identified and discarded. This can be extremely difficult to do when high speed stamping multi-out, progressive tooling modules that are producing thousands of products per minute are involved. It is very desirable to prevent the slug pulling in the first place. In conventional punch press applications where a reciprocating punch is arranged vertically above a fixed die, a vacuum system is most frequently used to augment the effect of gravity and friction to prevent the slugs from adhering to the punch and to pull the slugs downwardly into an exit cavity within the die tooling. However, this is not always an effective solution, especially where the stock being blanked is thin. The slugs will have very little mass and tend to adhere to the end of the punch more readily, especially if a thin film of lubricating oil, as is customary, is present on the surface of the strip material. It would, therefore, be desirable to provide a stamping and forming machine having the capability of preventing slug pulling. The present invention addresses this problem by providing a stamping and forming machine wherein each second stroke of the ram is used to strip the slug from the end of the punch, and importantly, the second stroke should be shorter than the first stroke, as will be explained. Conventional stamping and forming machines typically operate from about 600 to a maximum of about 1400 strokes a minute during most stamping and forming operations on strip material. The number of parts that can be made in a given unit of time on such a machine is directly related to the number of strokes per minute that the machine is capable of performing. Higher speed machines, therefore, would be correspondingly more productive.

What is needed is a high speed stamping and forming machine having a ram that performs two unequal length strokes for each machine cycle, the second of each double stroke being shorter than the first and used to strip the slug from the end of the punch. Additionally, to prevent reduced production output, the machine should operate in excess of 1400 double stroke machine cycles per minute and may, for example, operate up to 6000 double stroke machine cycles per minute.

SUMMARY OF THE INVENTION

A high speed machine is disclosed for performing stamping and forming operations on strip material. The machine includes a frame, a drive shaft journaled for rotation in the frame, and a base plate attached to the frame for holding first tooling. A ram is arranged to undergo reciprocating motion, in response to the rotation of the drive shaft. The ram is tightly guided and reciprocates within a ram guide in the frame toward and away from the base plate along a ram axis and is guided to limit lateral play. The ram carries second tooling that mates with the first tooling for performing the stamping and forming operations. Wherein for every 360 degrees of rotation of the drive shaft the ram is arranged to undergo reciprocating motion, both toward and away from the base plate, two times so that the ram moves away from the base plate for a different distance each of the two times.

DESCRIPTION OF THE PREFERRED EMBODIMENT

Figure 1:
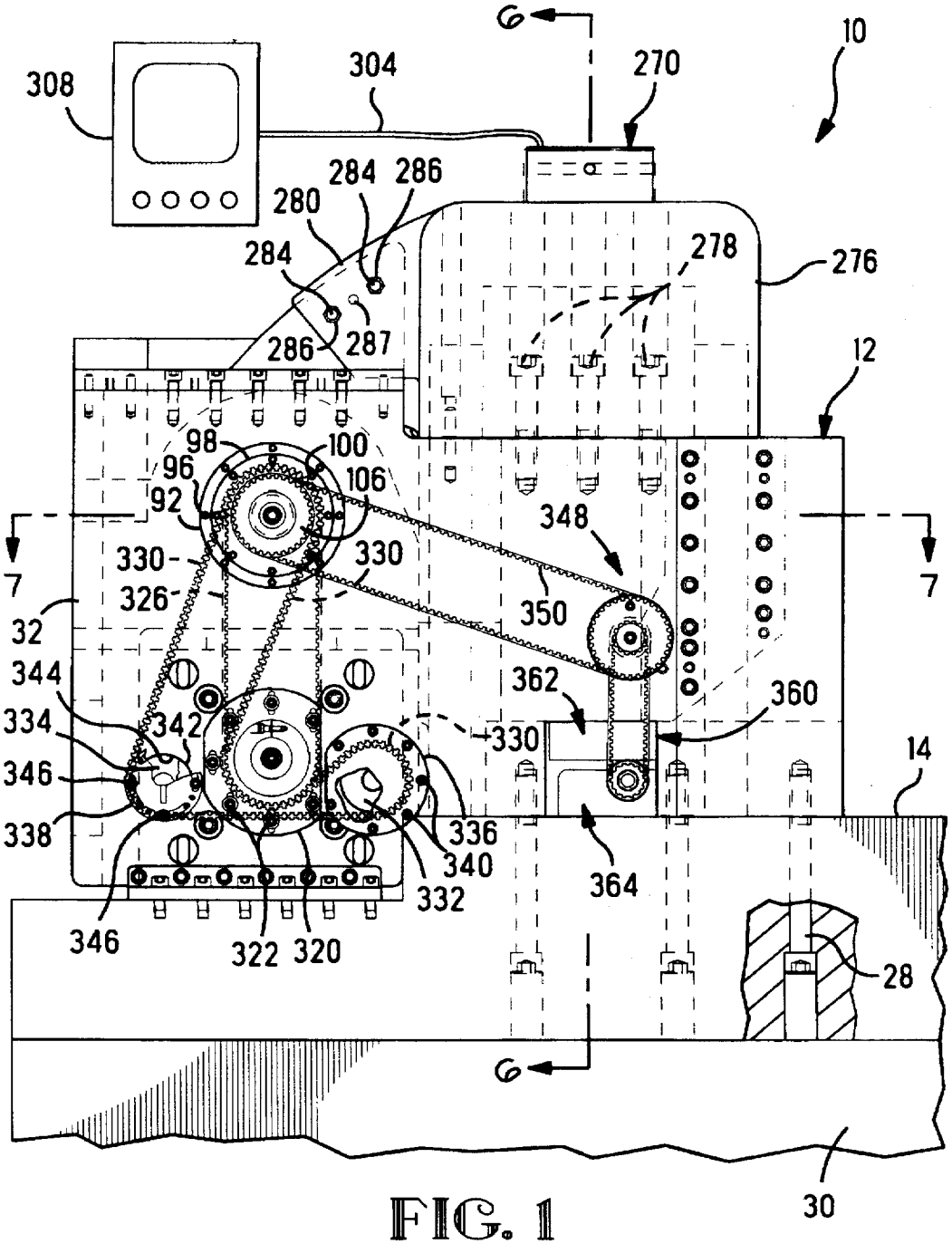
FIG. 1 is a side view of a stamping and forming machine incorporating the teachings of the present invention.
Figure 2:
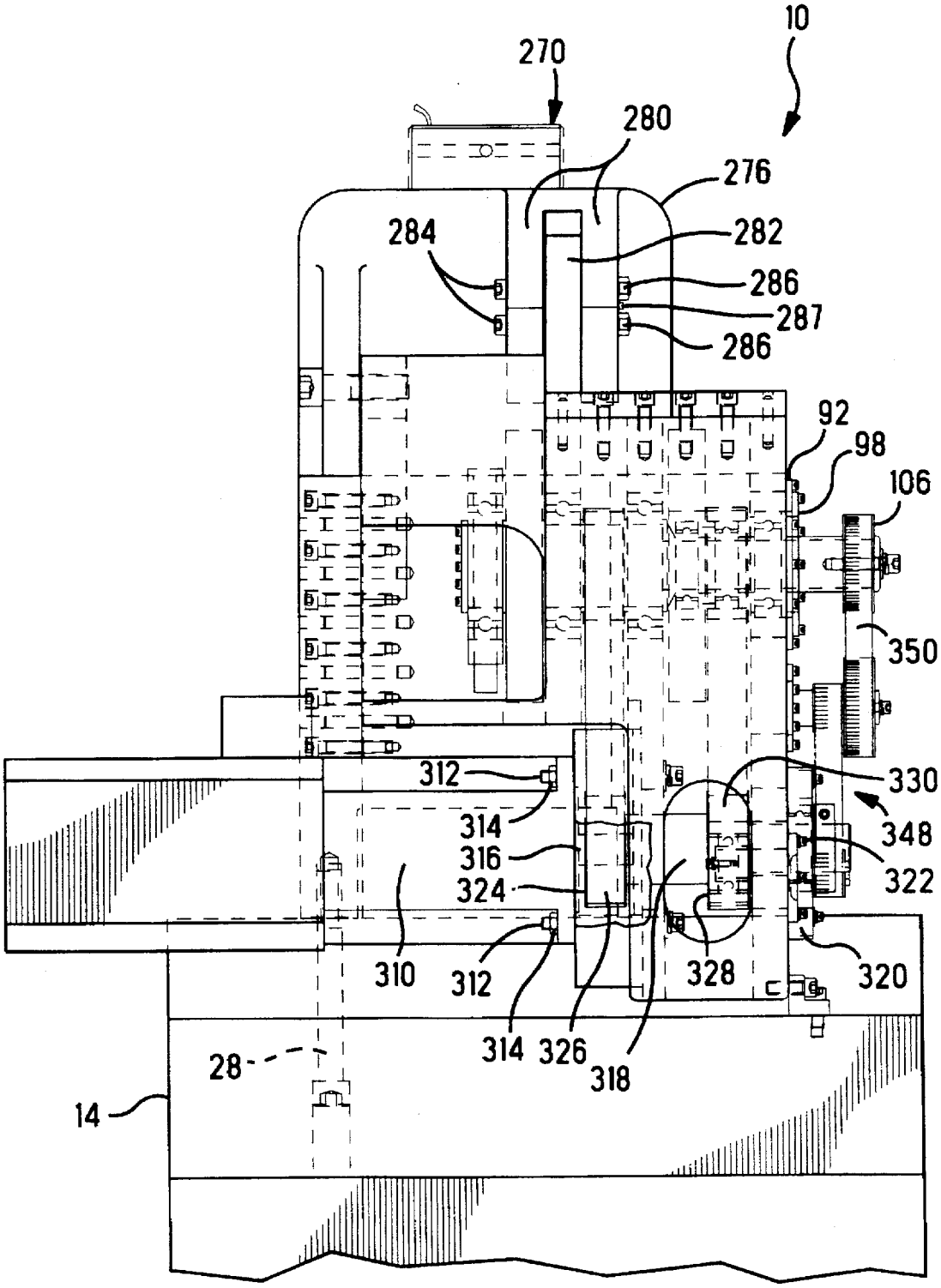
FIG. 2 is a rear view of the machine shown in FIG. 1.
Figure 3:
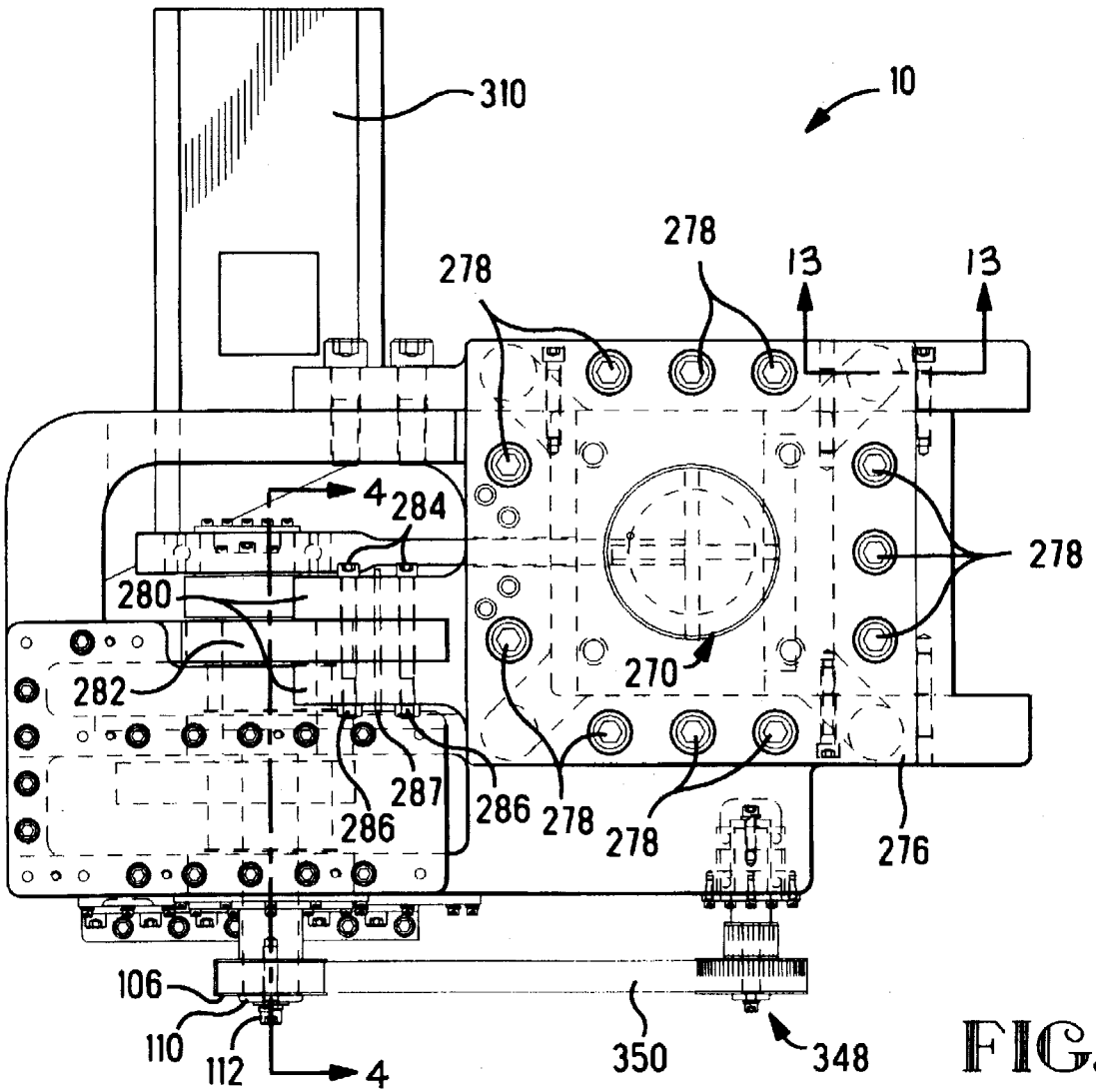
FIG. 3 is a top view of the machine shown in FIG. 1.
Figure 4:
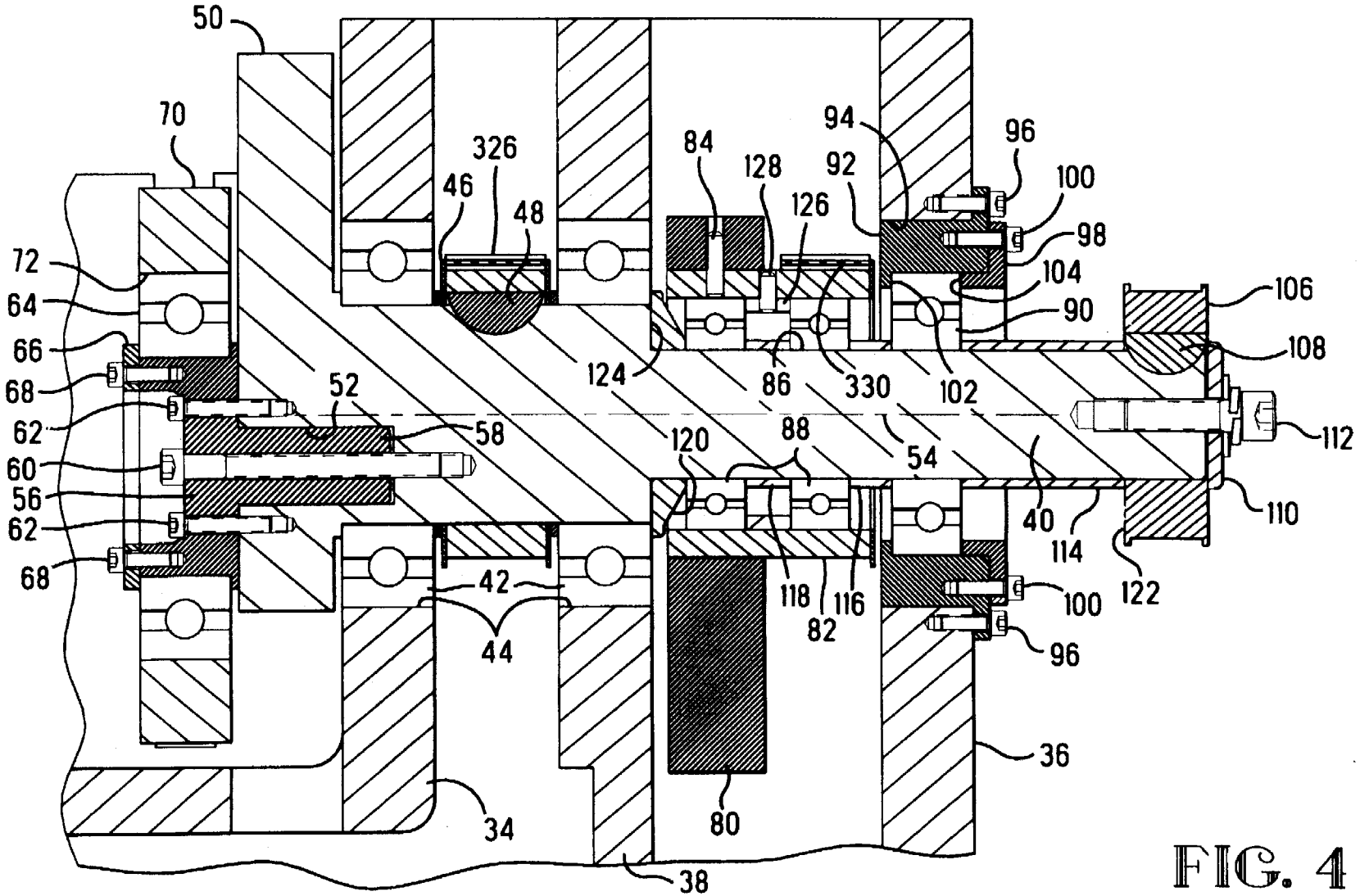
FIG. 4 is a cross-sectional view taken along the lines 4—4 in FIG. 3.
Figure 7:
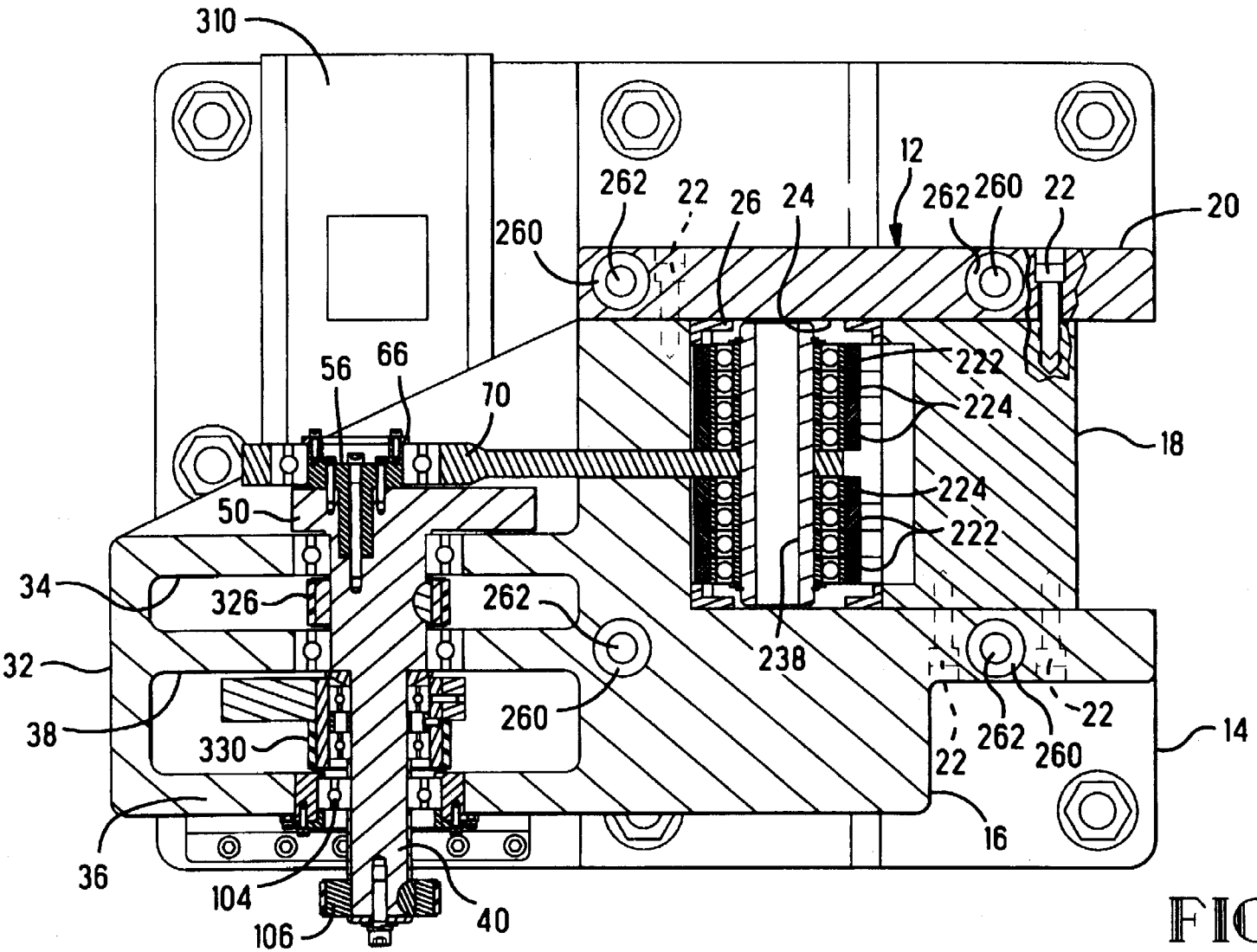
FIG. 7 is a cross-sectional view taken along the lines 7—7 in FIG. 1.

There is shown in FIGS. 1, 2, and 3, a stamping and forming machine 10 having a frame 12 rigidly secured to a bolster plate 14. The frame 12 consists of an L-shaped member 16, a front plate 18, and a right side plate 20, all of which are made of steel and bolted together by means of the bolts 22 to form a rigid frame, as best seen in FIG. 7. A rectangular shaped opening 24 is formed in the frame 12 and arranged to receive and guide a reciprocating ram 26 along a ram axis 27, shown in FIG. 5. As shown in FIGS. 1 and 2, the frame 12 is secured to the bolster plate 14 by means of bolts 28 that are threaded into holes in the frame. The bolster plate 14 is attached to a suitable base 30, such as concrete or other material for securely holding the machine and dampening vibration. The member 16 includes an extended portion 32 having two outer walls 34 and 36, and an interior wall 38. A drive shaft 40 is journaled for rotation in the extended portion 32, of the frame 12, as best seen in FIGS. 4 and 7. Two main ball bearings 42 are arranged in aligned slip fit bores 44 formed in the walls 34 and 38. A drive pulley 46 is coupled to the drive shaft 40 between the two bearings 42 by means of a woodruff key 48 in the usual manner. A first counterweight 50 is formed integral to the drive shaft, on the left end as viewed in FIG. 4, and a bore 52 is formed in that end off center with the axis 54 of the drive shaft. A crank pin 56 having a shank 58 that is a slip fit with the bore 52 is secured to the end of the drive shaft by means of a central bolt 60 and several smaller bolts 62 arranged in a bolt circle, all of which are tightly threaded into holes in the end of the drive shaft. A bearing 64 is arranged on the outer diameter of the crank pin 56 and held there by means of a retaining plate 66 and screws 68 that are threaded into holes in the crank pin. A connecting rod 70, which is arranged to drive the reciprocating ram 26, has a bore 72 that is a press fit with the outer diameter of the bearing. As the drive shaft 40 rotates, the crank pin 56 functions as an eccentric to impart oscillating motion to the connecting rod in the usual manner. A second counterweight 80 is arranged on a reduced diameter of a pulley 82 between the two walls 36 and 38, as shown in FIG. 4. The second counterweight is attached to the pulley 82 by a pin 84 and the pulley is journaled on a reduced diameter 86 of the drive shaft by means of two ball bearings 88. The reduced diameter 86 is journaled in the wall 36 by means of a ball bearing 90 which is arranged in a collar 92, the collar being in a bore 94 in the wall and held in place by screws 96. A secondary collar 98 is attached to the outer face of the collar 92 by means of the screws 100 so that the bearing 90 is held snugly between a shoulder 102 of the collar 92 and an end 104 of the secondary collar 98. An outboard pulley 106 is attached to the right end of the drive shaft, as viewed in FIG. 4, by means of a woodruff key 108 in the usual manner. A washer 110 having a screw 112 extending therethrough and threaded into the end of the drive shaft 40 hold the pulley 106 in place. As shown in FIG. 4, four spacers 114, 116, 118, and 120 are arranged on the reduced diameter 86 between a shoulder 124 and an inside surface 122 of the pulley, in conjunction with the bearing 90, to position the drive shaft 40 along its longitudinal axis 54. Another spacer 126 is pinned to the inside diameter of the pulley 82 by means of a pin 128, between the two bearings 88 to position the pulley 82 and the counterweight 80 between the two walls 36 and 38, as shown in FIG. 4.

Figure 10:
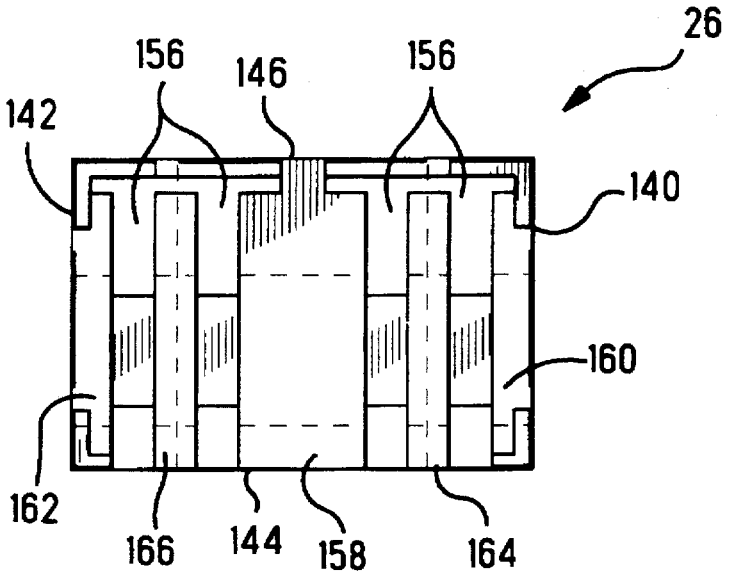
FIGS. 8, 9, and 10 are front, side, and top views, respectively, of the ram.
Figure 8:
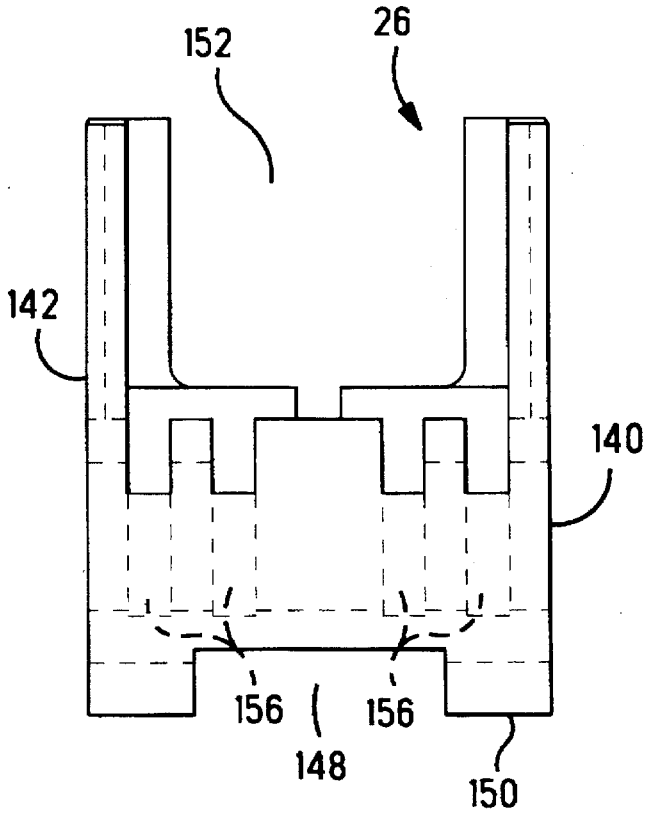
Figure 9:
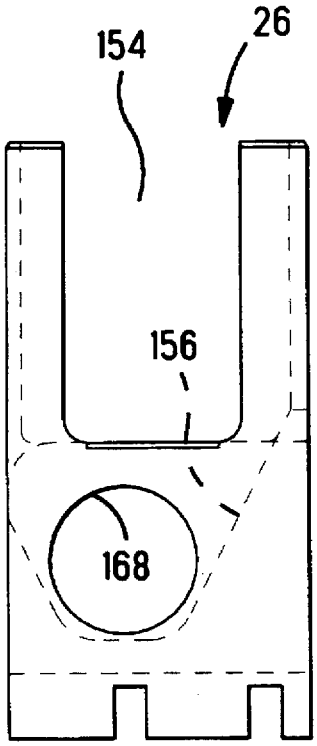

The ram 26, as shown in FIGS. 8, 9, and 10, is of generally rectangular cross section having two opposite side surfaces 140 and 142, and a front surface 144 and a rear surface 146. The ram 26 is sized to be a precision fit with the ram guide opening 24 so that the surfaces 140, 142, 144, and 146 are in sliding engagement with the walls of the opening. The precision fit must limit lateral movement of the ram 26 to within plus or minus 0.00005 inch. This will permit the use of mating punch and die tooling without a guide mechanism associated with the tooling. Such guide mechanisms would be adversely affected by the high operating speed of the machine 10. The ram includes a cutout 148 in its lower surface 150 for receiving tooling therein, not shown. The upper portion of the ram 26 includes cutouts 152 and 154 formed therein to reduce the mass of the ram. Four spaced apart identical cavities 156 are formed in the lower portion of the ram thereby forming a central web 158, right and left end webs 160 and 162, respectively, and right and left intermediate webs 164 and 166, respectively. A bore 168, as shown in FIG. 9, is formed through the lower portion of the ram, square with the side surfaces 140 and 142, and extending through the webs 158, 160, 162, 164, and 166.

Figure 11:
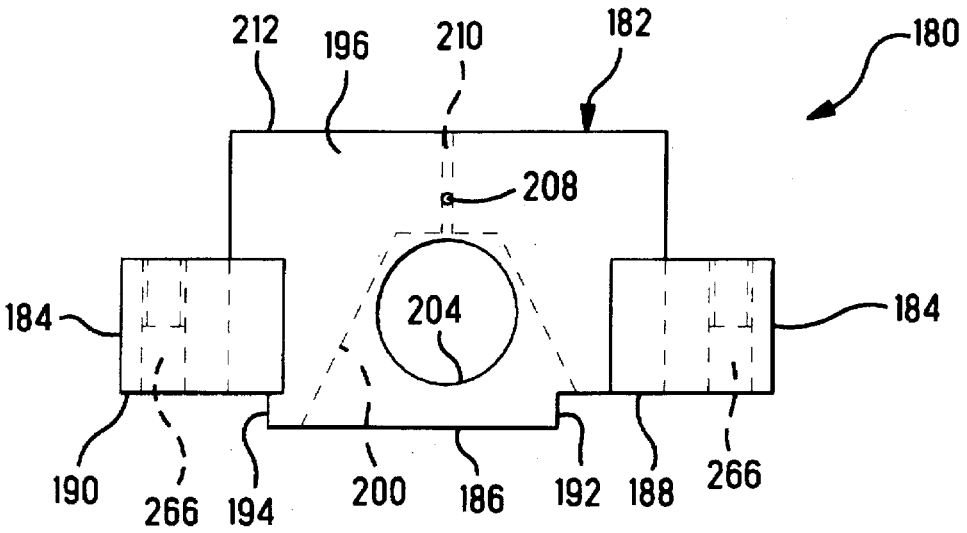
FIGS. 11 and 12 are front and bottom views, respectively, of the ram support.
Figure 12:
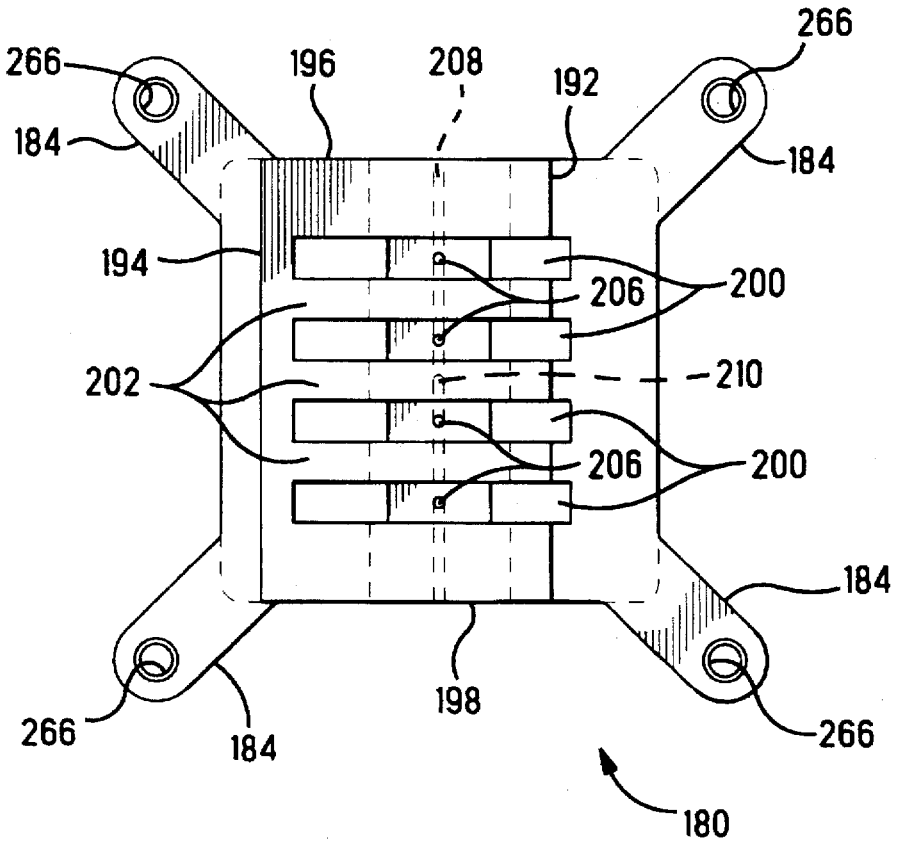

There is shown in FIGS. 11 and 12 a ram support 180 having a main body 182 of generally rectangular cross section and four flanges 184, one flange extending outwardly from each corner of the body. A bottom surface 186 includes two cutouts 188 and 190 that form right and left shoulders 192 and 194, respectively. The body 182 is sized so that its front and rear side surfaces 196 and 198 and the shoulders 192 and 194, as best seen in FIG. 12, form a bearing portion that is a slip fit with the ram guide opening 24. Four spaced apart identical cavities 200 are formed in the bottom surface 186 of the ram support thereby forming three webs 202. A bore 204 is formed completely through the ram support 180, square with the front and rear surfaces 196 and 198, and extending through the three webs 202. Oil supply holes 206 are formed in the bottom of each cavity 200, as best seen in FIG. 12, that intersect with a horizontally disposed oil passageway 208 which is in communication with an oil feed passageway 210 that is formed in the top surface 212 of the body 182.

Figure 5:
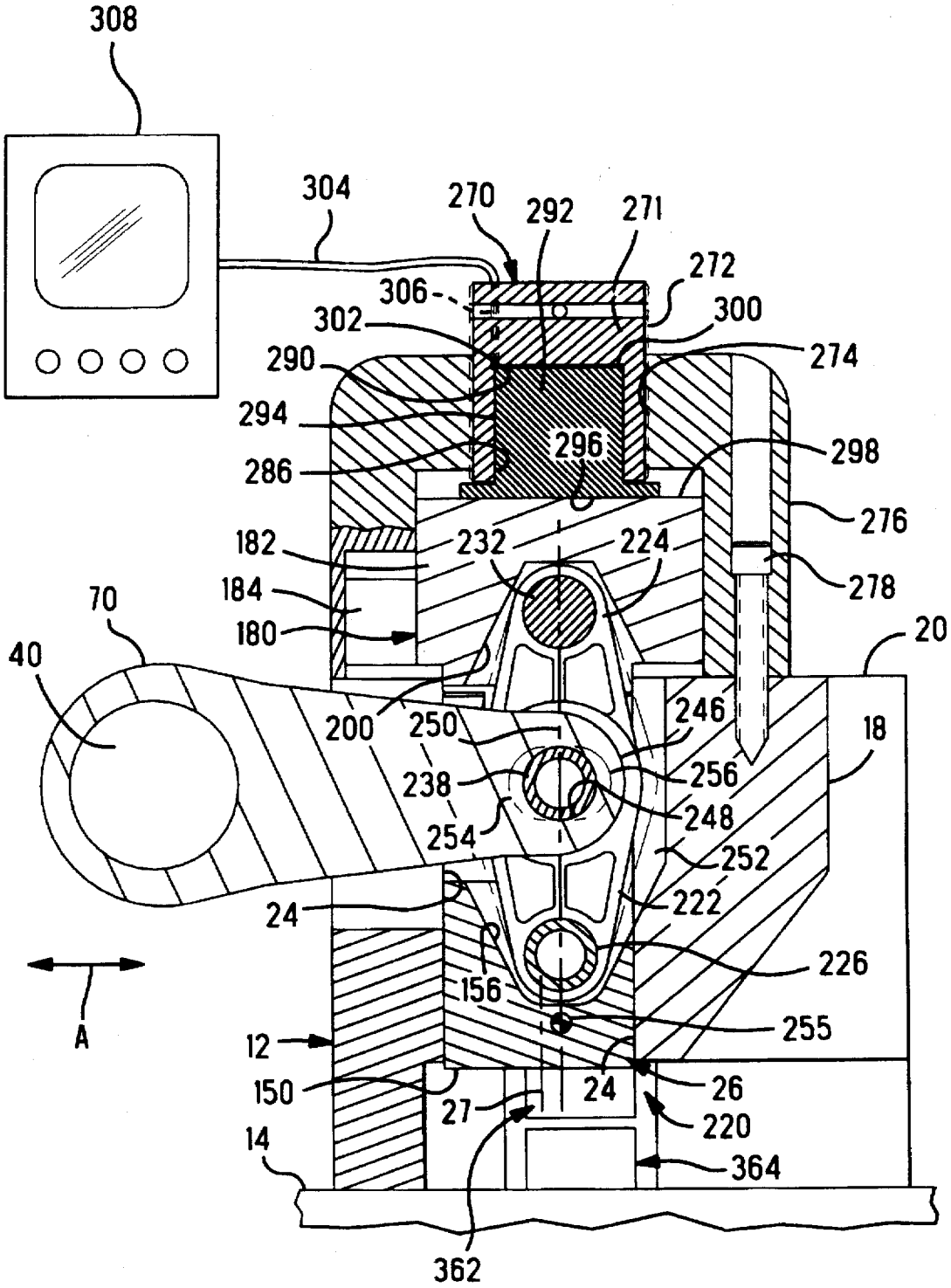
FIG. 5 is a cross-sectional view taken along the lines 5—5 in FIG. 2.
Figure 6:
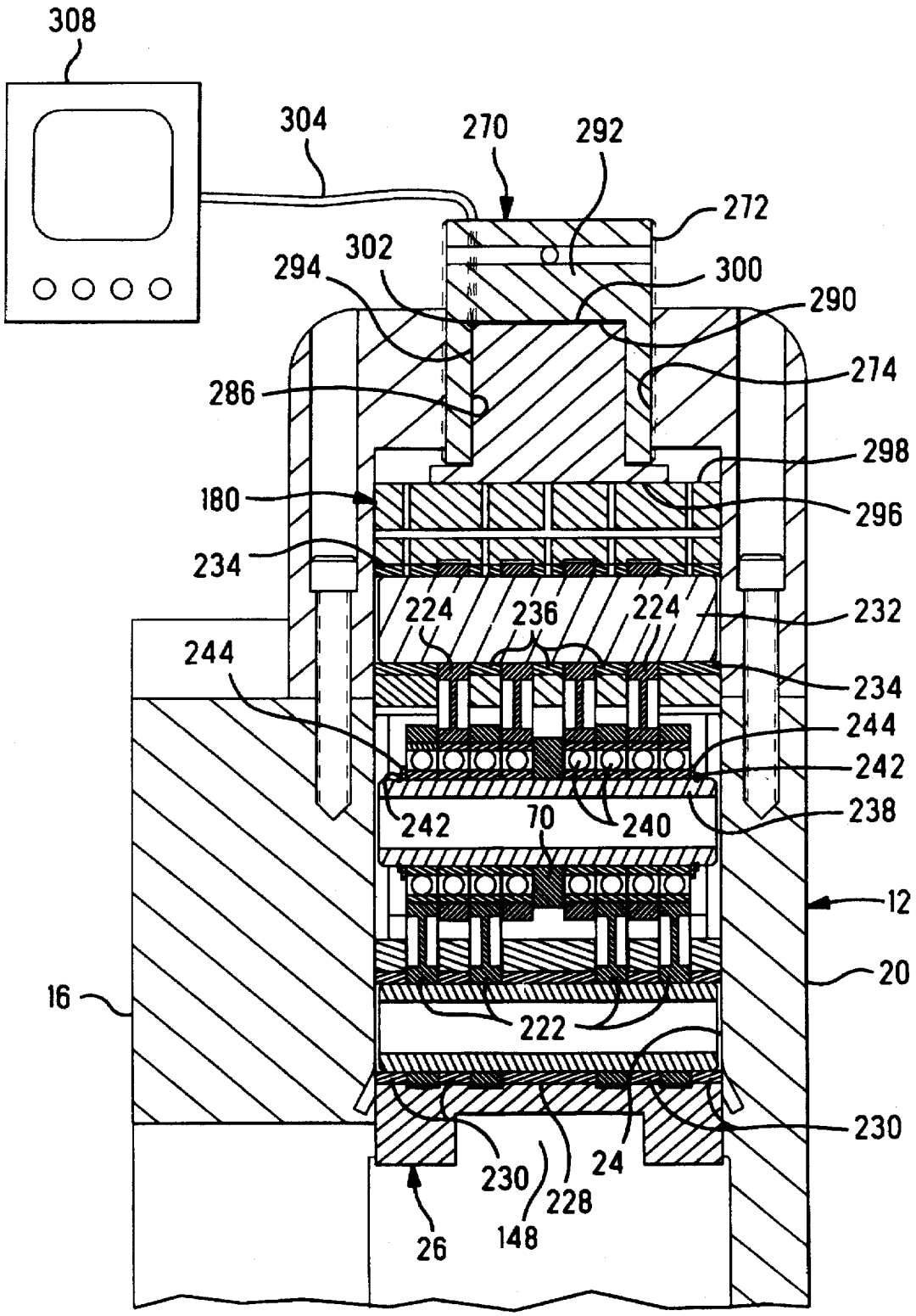
FIG. 6 is a cross-sectional view taken along the lines 6—6 in FIG. 1.

As best seen in FIGS. 5 and 6, the ram 26 and the ram support 180 are arranged in sliding engagement with the ram guide opening 24 with the end 150 of the ram extending into an opening 220 in the frame 12 and facing the bolster plate 14. The ram 26 and ram support 180 are coupled to the connecting rod 70 by four lower links 222 and four upper links 224. The lower links 222 are pivotally attached to the ram by means of a hollow pin 226 that extends through the bore 168, the bore being a larger diameter than the pin. A spacer sleeve 228 and four spacer sleeves 230 are arranged on the pin 226 between the links 222. Each of the sleeves is bronze and has an inside diameter that is a slip fit with the pin 226 and an outside diameter that is a press fit with the bore 168. The spacer sleeves position the lower links 222 laterally within their respective cavities 156 in the ram 26 and serve as a bearing for the pin 226. The spacer sleeves 228 and 230 are made by first pressing a single sleeve into the bore 168 and then machining the portions of the sleeve between the webs 158, 160, 162, 164, and 166. The upper links 224 are pivotally attached to the ram support 180 by means of a pin 232 that extends through the bore 204 of the ram support, the bore being a larger diameter than the pin. Two outer spacer sleeves 234 and three inner spacer sleeves 236 are arranged on the pin 232 between the links 224. Each of the sleeves is bronze and has an inside diameter that is a slip fit with the pin 232 and an outside diameter that is a press fit with the bore 204. The spacer sleeves position the upper links 224 laterally within their respective cavities 200 in the ram support 180 and serve as a bearing for the pin 232. The other ends of the upper and lower links are pivotally coupled to a central pivot pin 238 by means of ball bearings 240. Each link 222 and 224 has a bore that is a close slip fit with the outer diameter of a respective bearing 240 while the central pin 238 is a close slip fit with the inner diameter of the bearing. A pair of retaining rings 242 disposed in grooves in the pin 238 and spacer washers 244 serve to hold the four upper links 224 and the four lower links 222 in position on the central pin 238, as best seen in FIG. 6. An end 246 of the connecting rod 70 opposite the end journaled on the drive shaft 40 includes a bore 248 that is a close slip fit with the central pin 238, the end 246 being sandwiched between two upper links 224 so that two upper links and two lower links are on each side of the connecting rod 70, as best seen in FIG. 6. Note that the two outside upper links 224 are sandwiched between two lower links 222 and the two inside upper links 224 are sandwiched between a lower link 222 and the connecting rod 70, as best seen in FIG. 6. As the drive shaft 40 rotates, the off center crank pin 56 causes the end 246 of the connecting rod 70 to oscillate horizontally as indicated by the arrow A causing the central pin 238 to oscillate between the extreme left and right positions 254 and 256, respectively, shown in phantom lines in FIG. 5.

Note that in FIG. 5, the central pin 238 is shown on a centerline 250 that extends through the centers of both pins 226 and 232. This is the point in the machine cycle where the surface 150 of the ram 26 is closest to the bolster plate 14. As the drive shaft 40 rotates, the center of the central pin 238 moves from the position 254 that is extreme left of the centerline 250 to the position 256 that is extreme right of the centerline 250. The connecting rod 70 is arranged so that when the central pin 238 is in the left of centerline position 254 the surface 150 of the ram 26 is furthest away from the bolster plate 14 and when in the right of centerline position 256 the surface 150 is somewhat closer to the bolster plate. The reason that these distances are different is important, as will be set forth below. Both sets of cavities 156 and 200 are wider at their ends facing toward the central pin 238, as shown in FIG. 5, to provide clearance for the links 222 and 224 as the links are pivoted by the connecting rod 70. The cavity 156 includes an extended portion 252 in the inside surface of the front plate 18 for further clearance for the links. The ram 26, the upper and lower links 222 and 224, and the connecting rod 70 are made of titanium alloy to reduce the mass of the reciprocating parts, thereby maintaining moving part reaction force, and therefore peak loads on the bearings, within acceptable limits.

Figure 13A:
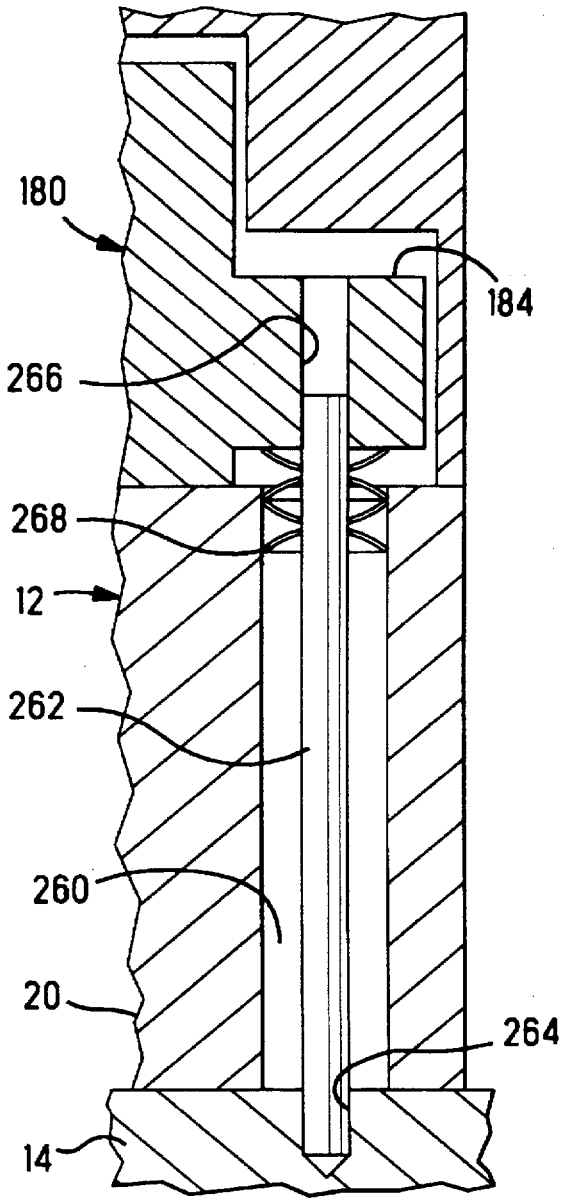
FIG. 13A is a cross-sectional view taken along the lines 13—13 in FIG. 3.
Figure 13B:
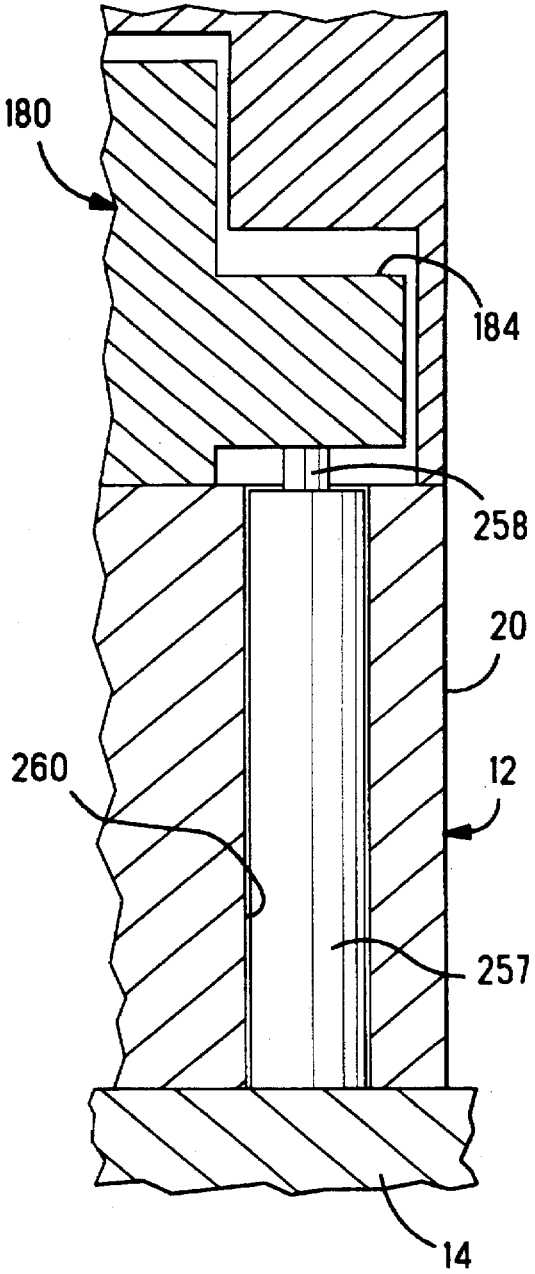
FIG. 13B is a view similar to that of FIG. 13A showing an alternative embodiment.

As shown in FIGS. 7 and 13, there are four 2.0 inch diameter holes 260 extending through the frame 12 parallel to the ram guide opening 24. A one inch diameter rod 262 is arranged in a blind hole 264 in the bolster plate 14, as best seen in FIG. 13A, in alignment with and centered within each hole 260. Each rod 262 extends from its respective hole 264 upwardly through the frame 12 and into sliding engagement with a respective hole 266 in a flange 184 of the ram support 180. A series of belleville spring washers 268 are alternately arranged on each rod 262, in a stack so that the stack extends from the bolster plate 14 into pressing engagement with the under surface of a respective flange 184. Each belleville spring washer 268 has a compressive force of about 9.0 tons so that the four stacks of spring washers urge the ram support 180 upwardly away from the bolster plate 14 with a total force of about 36 tons. The total distance that each stack can be compressed is about 0.375 inch thereby allowing the ram support 180 to travel a maximum of this much. A stack of belleville washers utilized in this way is but one example of a stored energy device that can be used to urge the ram support 180 upwardly. Other suitable spring or compressed gas stored energy devices may also be utilized, such as a nitrogen spring 257, as shown in FIG. 13B. The nitrogen spring 257 is disposed in the hole 260 and rests on the top surface of the bolster plate 14, as shown in FIG. 13B. A piston rod 258 extends from the nitrogen spring and into pressing engagement with the under surface of a respective flange 184. The four piston rods 258 urge the ram support upwardly with a force, in the present example, of about 36 tons. The nitrogen spring 257 is well known in the industry and can be obtained in various sizes. While the amount of force specified here is by way of example only, it is important that the total force from the four stacks of belleville washers or the nitrogen springs be larger than the reaction force of the retreating ram and attached tooling. While four stored energy devices 268, 256 were disclosed, in the present example, any suitable number of such devices may be used provided that they provide the necessary amount of force and they are arranged equally spaced about a vertical axes 250, as viewed in FIG. 5, that is parallel with the ram axes 27 and that extends through the center of gravity, indicated as 255, of the combined mass of the ram 26 and attached tooling 362.

As best seen in FIGS. 5 and 6, an adjustable stop 270 limits the upward movement of the ram support 180. The adjustable stop 270 includes an outer member 271 that is of cylindrical shape having a threaded outside diameter 272 that is in threaded engagement with a hole 274 formed in a cap 276, as best seen in FIGS. 5 and 6. The cap 276 is bolted to the top surface of the frame 12 by means of several bolts 278 that are threaded into holes in the frame 12. As shown in FIGS. 1, 2, and 3, the cap 276 includes a bifurcated flange 280 that straddles a single flange 282 extending from the wall 34 of the L-shaped member 16 and is bolted in place by means of two bolts 284, nuts 286, and a pin 287. The cap 276 completely encloses the top of the ram guide opening 24 and surrounds the upper portion of the ram support 180, as shown in FIGS. 5 and 6 and, along with the frame 12, is an integral part of the machine's structure. The outer member 271 has an interior bore 286 that is coaxial with the threaded diameter 272, terminating in a flat floor 290. A thrust member 292, disposed within the bore 286, has an outside diameter 294 that is a slip fit with the bore and a flat lower surface 296 in abutting engagement with the top surface 298 of the ram support 180, as shown in FIGS. 5 and 6. The thrust member 292 includes a top surface 300 that opposes the floor 290 of the outer member. A load cell 302, which is a relatively thin piezoelectric film, is sandwiched between the top surface 300 and the floor 290 and serves to transfer the upward loading of the ram support 180 to the cap 276 and frame 12, and to indicate the magnitude of the load. The load cell has a thickness of about 0.002 inch and a diameter of about 4.0 inches, in the present example, and is made from any suitable piezoelectric film that is commercially available. A pair of conductors 304 interconnected with metalized surfaces of the load cell 302 extend through a hole 306 in the adjustable stop 270 and are connected to a suitable pulse analyzing instrument 308, such as an oscilloscope. The loads of the stamping and forming operation that are transferred from the ram support 180 to the thrust member 292, cause the load cell to generate an electrical pulse in the conductors 304 having an amplitude that is proportional to the magnitude of the load. This pulse can be displayed on the oscilloscope 308 and the amplitude compared with a standard. If the amplitude of the pulse exceeds the value of the standard, this is an indication that the tooling has worn excessively, or that there is some other machine malfunction that must be determined. In such case the machine is shut down and the problem resolved before resuming production. The structure of the adjustable stop 270 permits manual rotation of the outer member 271 within the threaded hole 274 during operation of the machine 10 while the drive shaft is rotating. This adjustment causes the ram support 180, upper and lower links 224 and 222, and the ram 26 to move upwardly or downwardly as an assembly thereby selectively adjusting the shut height of the tooling by altering the height of the surface 150 from the bolster plate 14. This is important because it allows easy adjustment to maintain the stamping and forming product within tolerance without the need to stop the machine and lower production.

An electric motor 310 is rigidly attached to the wall 34 of the frame 12 by means of bolts 312 and nuts 314, as shown in FIGS. 2 and 3. The motor has a drive shaft 316 that is keyed and attached to one end of a pulley shaft 318. The other end of the pulley shaft 318 is journaled in a ball bearing housing 320 that is attached to the frame 12 by means of the screws 322. The pulley shaft 318 includes a main drive pulley 324 that is drivingly coupled to the drive pulley 46 on the drive shaft 40 by a timing belt or chain 326. The pulley shaft 318 also includes a pulley 328 that is drivingly coupled to the counterweight pulley 82 by means of a timing belt 330. As best seen in FIG. 1, the timing belt 330 is routed about two idler pulleys 332 and 334 that are journaled in bearing housings 336 and 338, respectively. The bearing housing 336 is rigidly attached to the frame 12 by means of screws 340. The bearing housing 338, on the other hand, is eccentrically coupled to the frame 12 by means of an eccentric diameter 342 on the bearing housing in engagement with a hole 344 in the frame, and is held in place by means of screws 346 extending through elongated holes in the bearing housing. The eccentric 342 can be rotated in the hole 344 to laterally move the idler pulley 334 thereby tightening or loosening the timing belt 330. The screws 346 are then tightened to hold the bearing housing 338 in place. The timing belt 330 has timing notches on both sides and, as shown in FIG. 1, is routed around the pulley 328 on the pulley shaft 318 and the two idler pulleys 332 and 334 in such a way that the second counterweight 80 rotates in a direction opposite that of the rotating first counterweight 50, each being 180 degrees out of phase with the other. The outboard pulley 106, in the present example as shown in FIGS. 1 and 2, is coupled to a feed mechanism 348 by means of a timing belt 350. The belt 350, however, may be used to drive any attachment or mechanism that is needed in conjunction with the operation of the specific tooling that is being used with the machine 10.

Figure 14:
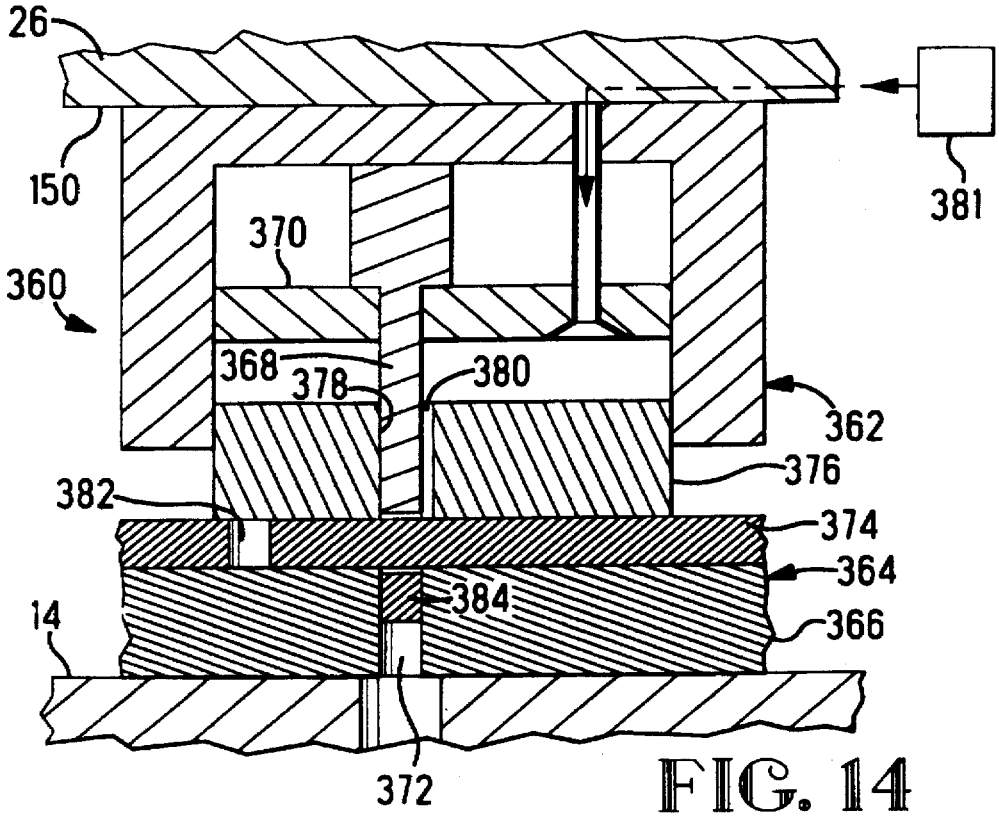
FIGS. 14, 15, 16, 17, and 18 are cross-sectional views of tooling that may be used with the present stamping and forming machine.

As best seen in FIGS. 1 and 14, stamping and forming tooling 360 is shown having a punch assembly attached to the surface 150 of the ram 26 and a die assembly 364 attached to the bolster plate 14, in an appropriate manner. The operation of the machine 10 will now be described with reference to the tooling 360 and FIGS. 14 through 18. The tooling 360 is shown in full cross section in FIG. 14 and in partial cross section in FIGS. 15 through 18, in various stages of operation. As shown in these figures, the tooling 360 includes a punch assembly 362 attached to the surface 150 of the ram 26 and a die assembly 364, in this case consisting of a die plate 366, attached to the bolster plate in the usual manner. A punch 368 is arranged in a punch holder 370 within the punch assembly in alignment with a die opening 372 in the die plate 366. A strip of material 374 is held against a surface of the die plate by a stripper plate 376 in pressing engagement therewith. The punch 368 is arranged vertically above and in alignment with the die opening 372 for blanking an opening in the strip 374. The punch 368 is partially guided in a guide opening 378 in the stripper plate, as best seen in FIG. 14, which also has a small groove 380 that is in communication with a source 381 of high pressure gas. Any suitable source of pressurized gas or air that exceeds about two atmospheres may be utilized.

Figure 15:
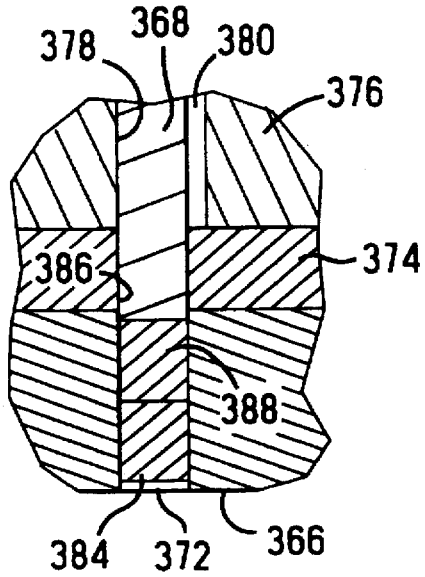
Figure 16:
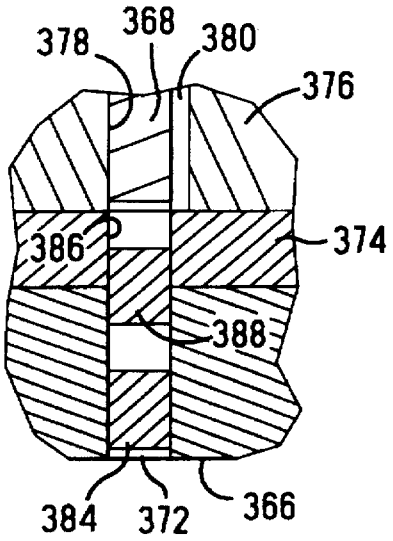
Figure 17:
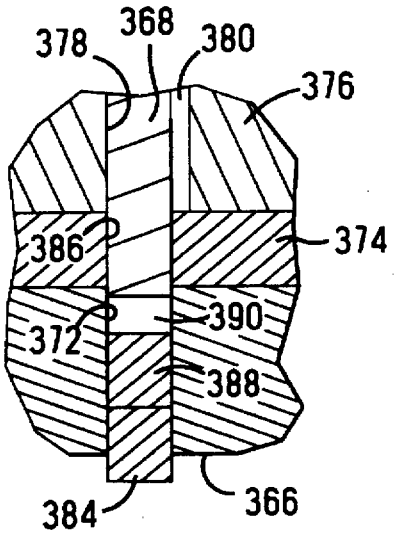
Figure 18:
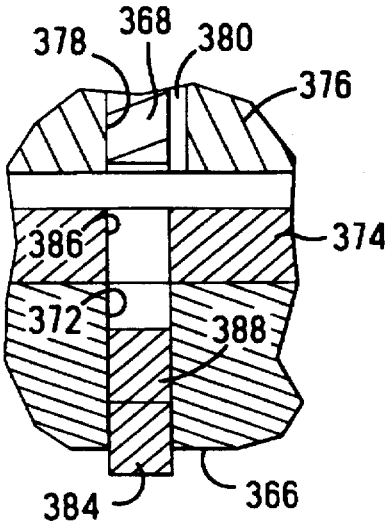

As shown in FIG. 14, the punch 368 has already formed an opening 382 in the strip 374 and a corresponding slug 384 is in the die opening 372. The strip material 374 has been advanced in position for the next punching operation and the drive shaft 40 is rotating so that the ram 26 is moving toward the bolster plate 14 with the stripper plate 376 already in engagement with the strip 374. At this point in the machine cycle, the central pivot pin 238 is to the left of the centerline 250, as viewed in FIG. 5, and moving to the right toward the centerline. As movement of the central pivot pin continues, the ram 26 moves further toward the bolster plate, causing the punch 368 to engage the strip 374 and form another opening therein, resulting in another slug 388 being pushed into the die opening 372 directly above the slug 384, as shown in FIG. 15, the central pivot pin 238 now being in alignment with the centerline 250, as shown in FIG. 5. As movement of the central pivot pin continues toward the right, as viewed in FIG. 5, the ram 26 begins to withdraw away from the bolster plate 14. The retreating punch 368 tends to carry the slug 388 with it due to a partial vacuum being created therebetween until the slug is partially within the opening 386. At this point the friction between the slug 388 and the sides of the opening 386 overcomes the force of the partial vacuum allowing the slug to separate from the end of the punch. The central pivot pin is now in its right most position 256, as viewed in FIG. 5, to the right of the centerline 250, and the punch is fully withdrawn from the strip material 374, as viewed in FIG. 16. However, the ram 26 moved upwardly in the ram guide opening 24 only a small amount so that the stripper plate is still firmly against the strip material. This completes the first half of the machine cycle where one half revolution of the drive shaft 40 has caused the punch 368, carried by the ram, to move into stamping engagement with the strip 374 and then to withdraw therefrom. As shown in FIG. 16, the withdrawn punch 368 permits communication between the groove 380 and the opening 386 so that high pressure gas from the source 381, shown in FIG. 14, floods the opening. As the drive shaft 40 continues to rotate and the central pivot pin 238 begins to move to the left toward the centerline 250, as viewed in FIG. 5, the ram 26 is caused to again move toward the bolster plate 14 forcing the punch 368 into the opening 386 a second time. As the punch enters the opening 386 it traps the high pressure gas and compresses it further causing the slug 388 to exit the opening 386 and enter into the die opening 372 against the slug 384, high pressure gas 390 remaining between the end of the punch 368 and the slug 388, as shown in FIG. 17. At this point in the machine cycle the central pivot pin 238 is again in alignment with the centerline 250 and moving toward the left, as viewed in FIG. 5. As the drive shaft continues to rotate toward completion of one full revolution, the central pivot pin 238 begins to move past the centerline 250 toward the left causing the ram 26 and punch 368 to withdraw away from the bolster plate 14. As the punch withdraws from the opening 386, the high pressure gas 390 retains the slug 388 within the die opening 372 as shown in FIG. 18. The ram 26 moves upwardly sufficiently so that stripper plate 376 withdraws from engagement with the strip 374, as shown in FIG. 18, and the central pivot pin 238 moves to its left most position 254, as shown in FIG. 5, thereby completing the second half of the machine cycle. The strip material 374 can now be advanced and the machine cycle repeated. Note that a single revolution of the drive shaft 40, one machine cycle, causes the ram 26 and punch assembly 362 to advance into engagement with the die assembly 364 and then to withdraw a short distance followed by a second advancement into engagement with the die assembly and then a complete withdrawal.

An important advantage of the present invention is that the ram of the machine performs two strokes for each machine cycle, the second of each double stroke being shorter than the first stroke and used to strip the slug from the end of the punch. Additionally, the machine is capable of sustaining relatively high speeds during stamping and forming operations, thereby substantially increasing production while still utilizing one of the double strokes to prevent slug pulling. Another important advantage is the shut height can easily be adjusted while the machine is operating thereby reducing down time.

I claim:

1. A high speed machine for performing stamping and forming operations on strip material, said machine having:

(a) a frame;

(b) a drive shaft journaled for rotation in said frame;

(c) a base plate attached to said frame for holding first tooling; and (d) a ram arranged to undergo reciprocating motion, in response to said rotation of said drive shaft, within a ram guide in said frame toward and away from said base plate along a ram axis, and to carry second tooling for mating with said first tooling for performing said stamping and forming operations, wherein for every 360 degrees of rotation of said drive shaft said ram is arranged to undergo said reciprocating motion two times so that said ram moves away from said base plate for a different distance each of said two times.

2. The machine according to claim 1 including:

(a) a toggle link assembly coupling said ram to said frame; and (b) a connecting rod having a first end coupled to said drive shaft by means of an eccentric coupling and a second end pivotally coupled to said toggle link assembly and arranged so that upon rotation of said drive shaft said connecting rod and said toggle link assembly cause said ram to undergo said reciprocating motion.

3. The machine according to claim 2 including: a ram support coupled to said frame and selectively movable along said ram axis toward and away from said base plate, wherein said toggle link assembly is pivotally attached at a first end to said ram and at a second end to said ram support.

4. The machine according to claim 3 wherein said toggle link assembly includes a plurality of upper links, a plurality of lower links, and a central pivot to which an end of each of said upper and lower links is pivotally coupled, The other end of each of said upper links being pivotally attached to said ram support and the other end of each of said lower links being pivotally attached to said ram.

5. The machine according to claim 4 wherein said second end of said connecting rod is pivotally attached to said central pivot of said toggle link assembly.

6. The machine according to claim 5 wherein said central pivot is a cylindrically shaped pin extending through an end of each of said upper and lower links.

7. The machine according to claim 6 wherein said toggle assembly is arranged so that when said connecting rod moves said central pivot in a first direction said ram undergoes a first of said two cycles of reciprocating motion and when said connecting rod moves said central pivot in a second direction opposite said first direction said ram undergoes a second of said two cycles of reciprocating motion.

8. The machine according to claim 7 wherein some of said upper links are between two of said lower links and wherein others of said upper links are between said connecting rod and a respective one of said lower links.

9. The machine according to claim 3 wherein said ram support includes a support member constrained by a guide within said frame to undergo only said selective movement along said ram axis, and a resilient member arranged to urge said support member outwardly in a first direction away from said base plate and maintain said support member in abutting engagement with an adjustable stop coupled to said frame.

10. The machine according to claim 9 wherein said guide is a portion of said ram guide.

11. The machine according to claim 9 wherein said ram support includes a bearing portion that is in sliding engagement with said portion of said ram guide.

12. The machine according to claim 9 wherein said adjustable stop is in threaded engagement with a threaded hole in said frame and is arranged so that when rotated in said threaded hole in a first direction said support member is moved toward said base plate along said ram axis and against the urging of said resilient member, thereby moving said toggle assembly toward said base plate, and when rotated in said threaded hole in a second direction said support member is moved away from said base plate along said ram axis under the urging of said resilient member.

13. The machine according to claim 12 wherein said adjustable stop has a threaded outside diameter that is in said threaded engagement with said threaded hole, said threaded outside diameter and said threaded hole arranged to support an abutting load against said adjustable stop along said ram axis outwardly away from said base plate of about 36 tons.

14. The machine according to claim 9 wherein said ram and said second tooling have a combined center of gravity with a vertical axis extending therethrough parallel with said ram axis, and wherein said resilient member comprises four separate resilient members equally spaced about said vertical axis.

15. The machine according to claim 14 wherein each said separate resilient member includes a plurality of belleville spring washers arranged in a stack, each stack in a hole in said frame arranged parallel to said vertical axis.

16. The machine according to claim 15 wherein said support member includes four flanges extending outwardly therefrom, each resilient member having one end thereof in abutting engagement with a respective said flange and the other end thereof in abutting engagement with a surface of said base.

17. The machine according to claim 16 wherein each said resilient member includes a sufficient number of spring washers of sufficient size so that said four resilient members provide a total force that is larger than the combined reaction force of said ram and said second tooling when said ram is moving away from said base plate.

18. The machine according to claim 17 wherein each said spring washer has an outside diameter of about 1.97 inches, an inside diameter of about 1.02 inches, and a thickness of 0.17 inch and wherein each stack contains about 96 spring washers arranged back to back.

19. The machine according to claim 14 wherein each said separate resilient member includes a nitrogen spring disposed in a hole in said frame and arranged parallel to said vertical axis.

20. A high speed machine for performing stamping and forming operations on strip material, said machine having:

(a) a frame;

(b) a drive shaft journaled for rotation in said frame;

(c) a base plate attached to said frame for holding first tooling;

(d) a ram arranged to undergo reciprocating motion, in response to said rotation of said drive shaft, within a ram guide in said frame toward and away from said base plate along a ram axis, and to carry second tooling for mating with said first tooling for performing said stamping and forming operations;

(e) a ram support coupled to said frame and selectively movable along said ram axis toward and away from said base plate;

(f) a toggle link assembly coupling said ram to said ram support wherein said toggle link assembly is pivotally attached at a first end to said ram and at a second end to said ram support; and (g) a connecting rod having a first end coupled to said drive shaft by means of an eccentric coupling and a second end pivotally coupled to said toggle link assembly and arranged so that upon one rotation of said drive shaft said connecting rod and said toggle link assembly cause said ram to undergo two cycles of said reciprocating motion.

21. The machine according to claim 20 wherein said toggle link assembly includes a plurality of upper links, a plurality of lower links, and a central pivot to which an end of each of said upper and lower links is pivotally coupled, the other end of each of said upper links being pivotally attached to said ram support and the other end of each of said lower links being pivotally attached to said ram.

22. The machine according to claim 21 wherein said second end of said connecting rod is pivotally attached to said central pivot of said toggle link assembly.

23. The machine according to claim 22 wherein said toggle assembly is arranged so that when said connecting rod moves said central pivot in a first direction said ram undergoes a first of said two cycles of reciprocating motion and when said connecting rod moves said central pivot in a second direction opposite said first direction said ram undergoes a second of said two cycles of reciprocating motion.

24. The machine according to claim 20 wherein said ram support includes a support member constrained by a guide within said frame to undergo only said selective movement along said ram axis, and a resilient member arranged to urge said support member outwardly in a first direction away from said base plate and maintain said support member in abutting engagement with a adjustable stop coupled to said frame.

25. The machine according to claim 24 wherein said guide is a portion of said ram guide.

26. The machine according to claim 24 wherein said ram support includes a bearing portion that is in sliding engagement with said portion of said ram guide.

27. The machine according to claim 24 wherein said adjustable stop is in threaded engagement with a threaded hole in said frame and is arranged so that when rotated in said threaded hole in a first direction said support member is moved toward said base plate along said ram axis and against the urging of said resilient member, thereby moving said toggle assembly toward said base plate, and when rotated in said threaded hole in a second direction said support member is moved away from said base plate along said ram axis under the urging of said resilient member.

28. The machine according to claim 27 wherein said adjustable stop has a threaded outside diameter that is in said threaded engagement with said threaded hole, said threaded outside diameter and said threaded hole arranged to support an abutting load against said adjustable stop along said ram axis outwardly away from said base plate of about 36 tons.

29. The machine according to claim 20 wherein said ram and said second tooling have a combined center of gravity with a vertical axis extending therethrough parallel with said ram axis, and wherein said resilient member comprises a plurality of separate resilient members equally spaced about said vertical axis.

30. The machine according to claim 29 wherein each said separate resilient member includes a plurality of belleville spring washers arranged in a stack, each stack in a hole in said frame arranged parallel to said vertical axis.

31. The machine according to claim 30 wherein said support member includes a plurality of flanges extending outwardly therefrom, each resilient member having one end thereof in abutting engagement with a respective said flange and the other end thereof in abutting engagement with a surface of said base.

32. The machine according to claim 31 wherein each said resilient member includes a sufficient number of spring washers of sufficient size so that said plurality of resilient members provide a total force that is larger than the combined reaction force of said ram and said second tooling when said ram is moving away from said base plate.

33. The machine according to claim 32 wherein each said stack includes a sufficient number of spring washers of sufficient size to provide about nine tons of force over a distance of from about 0.1 inch to about 0.8 inch.

34. The machine according to claim 29 wherein each said separate resilient member includes a nitrogen spring disposed in a hole in said frame and arranged parallel to said vertical axis.

35. The machine according to claim 34 wherein each said spring washer has an outside diameter of 1.97 inches, an inside diameter of about 1.02 inches, and a thickness of 0.17 inch and wherein each stack contains about 80 to about 120 spring washers arranged back to back.

36. The machine according to claim 20 wherein said ram is arranged to undergo two cycles of said reciprocating motion for every 360 degrees of rotation of said drive shaft, each said cycle comprising motion both toward and away from said base plate.

* * * * *